United States Patent [19]

Sukup et al.

[11] Patent Number: 4,706,933

[45] Date of Patent: Nov. 17, 1987

[54] OIL AND GAS WELL SAFETY VALVE

[76] Inventors: Richard A. Sukup, 2524 Mockingbird Rd., Burleson, Tex. 76028; Joseph Shoaf, 2341 Kings Country Dr., Irving, Tex. 70038

[21] Appl. No.: 780,793

[22] Filed: Sep. 27, 1985

[51] Int. Cl.[4] ..... F16K 1/20; F16K 31/122; F16K 47/08

[52] U.S. Cl. ..... 251/54; 166/320; 166/332; 251/58; 251/303

[58] Field of Search ..... 251/298, 299, 303, 54, 251/58, 47; 166/319, 317, 320, 321, 322, 323, 324, 330, 332, 333, 117.5

[56] References Cited

U.S. PATENT DOCUMENTS

| | | | |
|---|---|---|---|
| 1,180,583 | 4/1916 | Gagg | 251/54 X |
| 1,560,439 | 11/1925 | Trenor | 251/54 |
| 2,786,535 | 3/1957 | Boer et al. | 166/321 |
| 2,798,561 | 7/1957 | True . | |
| 3,016,955 | 1/1962 | Magill et al. . | |
| 3,035,641 | 5/1962 | Page . | |
| 3,035,642 | 5/1962 | Page . | |
| 3,071,151 | 1/1963 | Sizer . | |
| 3,078,923 | 2/1963 | Tausch . | |
| 3,177,894 | 4/1965 | Camp | 251/54 X |
| 3,799,204 | 3/1974 | Watkins et al. . | |
| 3,845,818 | 11/1974 | Deaton . | |
| 3,850,242 | 11/1974 | Crowe . | |
| 3,865,141 | 2/1975 | Young . | |
| 3,868,995 | 3/1975 | Crowe . | |
| 3,942,551 | 3/1976 | Schuller et al. | 251/54 X |
| 3,958,633 | 5/1976 | Britch et al. | 166/321 X |
| 3,980,135 | 9/1976 | Garrett . | |
| 4,069,871 | 1/1978 | Page, Jr. . | |
| 4,376,464 | 3/1983 | Crow . | |

OTHER PUBLICATIONS

ASME, "Emergency Shut-Down Systems—Evolution and Status", dated Jun. 1, 1977.

Drilling, "Designs in Subsurface Safety Valves Introduced", dated Apr. 15, 1984.

Oil & Gas Journal, "Safety Systems Demand Extensive Design Study", dated Sep. 15, 1975.

*Primary Examiner*—Martin P. Schwadron

*Assistant Examiner*—Stephen M. Hepperle

*Attorney, Agent, or Firm*—Richards, Harris, Medlock & Andrews

[57] ABSTRACT

An oil or gas well flapper-type safety valve is joined in the tubing string and has a cylindrical valve body with a valve seat therein. A flapper valve is hingedly supported from the valve body for movement between a closed position wherein the valve is seated against the seat and an open position wherein the valve is pivoted from the seated position. A control link is attached to the flapper valve at a point removed from the hinge. Control structure is provided for applying a force to the valve through the control link to selectively pivot the valve between its closed and open position. The control structure includes an hydraulically operated piston moveable in a valve control cylinder. The piston is attached to one end of the control link and is biased by a compression spring toward the valve to seat the valve. A pressure supply is communicated to the cylinder in which the piston moves and by applying pressure to the piston to overcome the bias provided by the compression spring, the piston moves downwardly in its cylinder. By way of the control link between the piston and valve, the valve is pivoted to its open position. Closure is likewise controlled by the control of the discharge of fluid from the cylinder.

2 Claims, 6 Drawing Figures

OIL AND GAS WELL SAFETY VALVE

TECHNICAL FIELD

The present invention relates to safety valves for use in oil and gas wells for control of pressure during production cycles, and more particularly, to flapper-type safety valves.

BACKGROUND OF THE INVENTION

Various safety systems have been designed and implemented for automatically shutting in oil and gas wells. Such systems are used in the event of damage or malfunction of the wellhead, production facilities, pipelines, or the like, by fire, explosion or other accidents. Further, these systems may be automatically operated in the event of high or low flow line pressure changes. Generally, these safety valves are set below ground level in the casing or tubing string. However, such valves may also be used near or at the wellhead surface.

Use of such valves is of critical importance in reducing risk to human life and property which may result from uncontrolled oil or gas flow. Further, such valves are critical to reducing or eliminating emergency flow which could result in environmental damage. The use of such devices reduce the likelihood of needless lost of oil or gas which could occur in emergency situations.

A wide variety of designs have been employed in such safety valves. The most common designs are referred to as the flapper-type and ball-type. Poppet or gate valves have also been employed.

The ball-type safety valve design includes a spherical or near spherical valve having a port therethrough which when aligned with the flow channel of the tubing string permits flow therethrough. By rotating the spherical valve to interrupt the alignment, flow past the valve is arrested. Because of the necessary design of the ball-type valve, the port through the valve is substantially smaller in dimension than that through the production tubing. Thus, the valve introduces a restriction in the well tubing or casing which will not easily accommodate production tubing and tools or instruments necessary for production completion, testing or stimulation. Further, such valves do not lend themselves as readily to surface control.

Poppet valves or gate valves are also used in the design of safety valves, but these valves also introduce restrictions in the bore which do not easily permit the accommodation of tools and instruments, or production tubing for positioning or manipulation of such devices, below the safety valve.

Flapper-type valves have found substantial acceptance in the design of safety valves. In prior art flapper valves, a valve body supports a gate from a hinge which permits the valve to be pivoted against the wall of the valve and out of the way of the passageway through the valve. The valves are normally cammed open by the movement of a sleeve, under the action of hydraulic pressure, against the valve to pivot it to its open position. Closure of the valve is accomplished by the withdrawal of the actuating sleeve and the action of a return spring on the valve for pivoting the valve to its closed position. Further, closure of the valve is, in almost all cases, accompanied by a substantial pressure differential across the valve itself. Normally, flow is moving up the well bore, in the direction of the movement of the valve. Generally, this pressure differential may be on the order of thousands of pounds, and thus substantial forces can be exerted on the valve due to fluid velocity. As a result, substantial failure has been experienced in such valves, particulary at the hinge point due to high stress concentrations. This has been in part due to the uncontrolled closure and in view of the design which concentrates loading on the hinge pin area of the valve.

Thus, the need exists for a surface controllable safety valve which permits the controlled closure of the valve without the attendant loading and resultant stresses to which the valve and seat are subjected in prior devices. Further, this controlled closure must be accomplished by providing a design resulting in an unrestricted bore such that tools and instruments moved in the casing may pass through the valve as necessary.

DISCLOSURE OF THE INVENTION

The present invention includes an oil or gas well flapper-type safety valve. The valve is surface controlled and may be positioned either subsurface or at or near the surface of the well bore. The valve is joined in the tubing string and has a cylindrical valve body with a valve seat therein. A flapper valve is hingedly supported from the valve body for movement between a closed position wherein the valve is seated against the seat and an open position wherein the valve is pivoted from the seated position. A control link is attached to the flapper valve at a centralized point removed from the hinge. Control structure is provided for applying a force to the valve through the control link to selectively pivot the valve between its closed and open position.

In one embodiment of the invention, the control structure comprises a hydraulically actuated piston moveable in a valve control cylinder. The piston is attached to one end of the control link, and is biased by a compression spring toward the valve to seat the valve. A pressure supply, from a surface controller, is communicated to the cylinder in which the piston moves and by applying pressure to the piston to overcome the bias provided by the compression spring, the piston moves downwardly in its cylinder. By way of the control link between the piston and the valve, the valve is pivoted about its hinge to its open position. Closure is likewise controlled by the control of the discharge of fluid from the piston cylinder.

Further, a damping structure is provided to control the movement of the piston in its cylinder. In accordance with this more specific embodiment of the invention, the safety valve includes a damping means, in addition to the control means for restricting movement of the control link and thereby preventing slamming closure of the valve. In one embodiment of the invention, the damping means includes a shock absorber piston for movement in the valve control cylinder. This piston is linked to and moved with the control piston. A predetermined port is provided through the piston which communicates with the cylinder area to both sides of the piston. Although a fluid, such as oil, is loaded in the cylinder in which the piston translates, the port through the piston permits the movement of the piston. The size of the port can be selected to provide a predetermined resistance to movement and therefore provide a damping force to the control link and therefore to the valve.

In a further embodiment of the invention, the control link is attached to the center of the valve substantially removed from the valve hinge. Further, the hydraulically actuated piston moves in a cylinder having the extension of its longitudinal axis passing substantially through the valve hinge.

The valve system of the present invention also incorporates an equalizing valve for equalizing pressure across the valve to facilitate opening of the valve. The equalizing valve includes a piston operable in a cylinder having ports opening therefrom and communicating to opposite sides of the valve. A tension spring retains the piston in a first position which prevents communication between the ports through the cylinder. By applying pressure against the piston to overcome the spring force exerted thereon, the piston may be made to move to a second position whereby communication of pressure is permitted through the cylinder to both sides of the valve. In this way, pressure is equalized across the valve and opening of the valve is readily facilitated.

Thus, the present invention provides a surface-controlled, subsurface safety valve. The valve is an equalizing, flapper-type, tubing retrievable valve. The valve permits complete control of the closure of the valve through the application of hydraulic pressure to move a piston operable in a cylinder positioned in the valve which is attached by way of a control link to the hinged flapper valve. The piston is opposed by a compression spring which maintains the valve in a normally closed position. Actuation of the valve by the introduction of hydraulic pressure acts to compress the spring. The valve remains open by pressure applied thereto, and closed when pressure is released.

In the event of loss of hydraulic pressure in the control line and cylinder, the piston spring moves the piston upwardly, transmitting such movement by way of the control link to the valve causing its closure. A flapper valve spring is mounted at the point of connection between the control link and the valve to assist in closing the valve. Pressure differential above and below the valve assist in the closure. However, an internal shock absorber is provided which prevents the valve from slamming shut during closing. This shock absorber piston is attached by way of a shaft and moves with the primary piston. The shock absorber piston includes a port communicating to both sides of the piston and permits a metered amount of fluid to pass through the port to permit controlled movement of the piston.

As can be appreciated, in both applying an opening force to the valve and in resisting closure of the valve, forces transmitted to the valve are not applied solely to the valve hinge. Instead, these loads, which can approach several thousand pounds are distributed between two points of connection between the valve and its support and control structure.

An equalizing valve is provided to permit reduction of differential pressure across the valve and permit reopening. Pressure is applied at the surface tubing (production) port on the wellhead and is transmitted by way of the production work string to an equalizing piston which is moved to an unseated position. The area of the equalizing piston confronting the pressure from the surface tubing port is greater than that exposed to the well pressure. Thus, the surface pressure necessary to equalize or unseat the valve is less than the well hydrostatic pressure. In its unseated position, the equalizing system permits pressure to enter through an equalizing port to communicate the same pressure above and below the valve.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION

Figure 1:
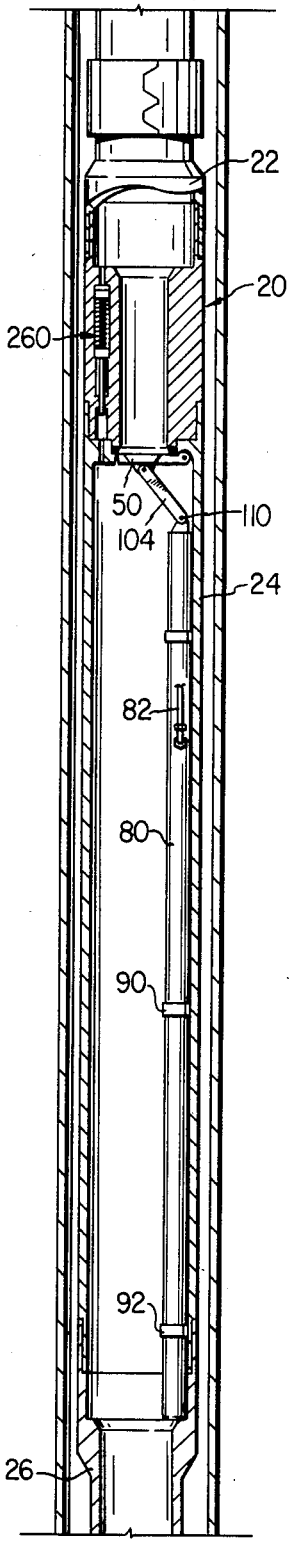
FIG. 1 is a partial broken away section view of the safety valve according to the present invention with the flapper valve and equalizer valve in their closed position.

Referring specifically to FIG. 1, a subsurface safety valve 20 for use in oil and gas wells includes a top sub 22 having internal threads for mating with external threads of valve body 24. A bottom sub 26 is joined to the lower end of valve body 24, the bottom sub having internal threads for mating with the external threads of the valve body. Appropriate seals, as is well known in the art, are used at the junctures between the top sub and bottom sub and the valve body.

The safety valve of the present invention is of the flapper-valve type including a flapper valve 50 which hinges from an internally formed ring 52 in valve body 24. Referring to FIG. 1 in conjunction with the enlargement of FIG. 2, flapper valve 50 is pivotally attached to ring 52 by pivot pin 54. Valve 50 has hinge lugs 56 for cooperating with lug 58 formed in ring 52. Appropriate apertures are formed through lugs 56 and 58 for receiving pin 54 therethrough.

Ring 52 defines a valve seat 60 wherein a primary seal 62, formed of an appropriate resilient material, is provided. A secondary seat 64, which provides for a metal to metal seal upon failure of primary seal 62, is designed therein. Flapper valve 50 is designed with a seal seat surface 70 corresponding to the seats provided by primary seal 62 and secondary seal 64.

Figure 2:
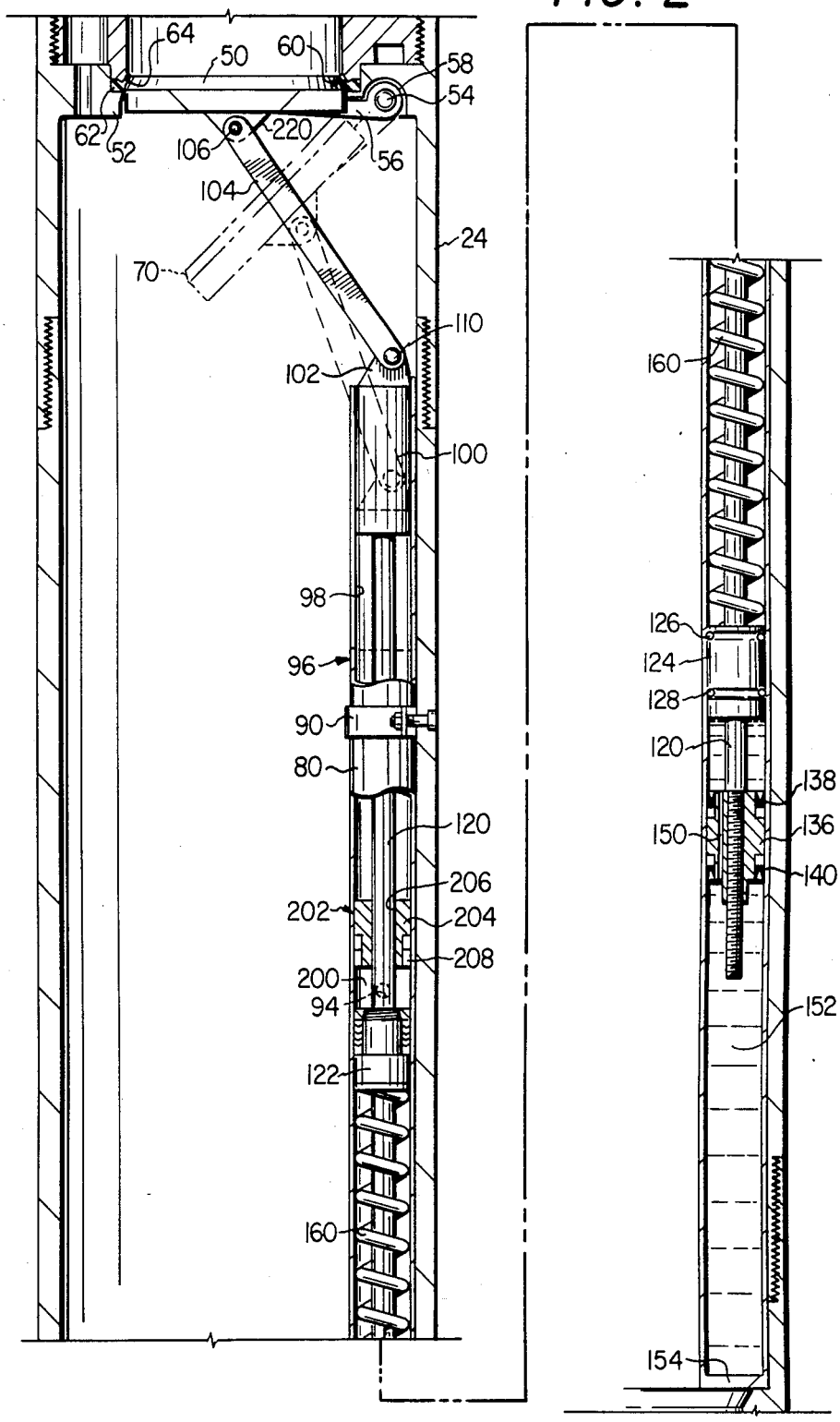
FIG. 2 is an enlarged section of the valve and valve control structure of the present invention.

Referring still to FIG. 1 in conjunction with the enlargement of FIG. 2, valve body 24 houses a valve control assembly within a cylindrical control body 80. As can be seen in FIG. 1, a fluid control line 82 is connected into control body 80 using appropriate fittings. Control line 82 is provided for the insection and exhaust of fluid into and from control body 80 as will be described hereinafter in greater detail. Control body 80 is attached to valve body 24 using appropriate saddles 90 and 92.

As can be seen in FIG. 2, the inlet of control line 82 into control body 80 is defined by port 94. Referring still to FIG. 2, control body 80 defines a valve control cylinder 96 having a slot 98 extending from the uppermost end to a point just above saddle 90. A control piston 100 is provided for movement within valve control cylinder 96. A lug 102 is positioned on the top side of cylinder 100, and a control link 104 is mounted at lug 102 using pin 110. The opposite end of control link 104 is pivotally secured to flapper valve 50 at lug 106, using an appropriate pin 108. As can be seen in FIG. 2, the point of connection of control link 104 to flapper valve 50 is at a point substantially intermediate the point of pivoting of valve 50 from valve body 24 and the opposite end of the valve.

A connecting rod 120 extends from the bottom side of control piston 100 into valve control cylinder 96. A primary piston 122 is mounted for movement with connecting rod 120. Rod 120 passes through a fixed spring retention block 124 which is sealingly engaged, using appropriate O-rings 126 and 128, to valve control cylinder 96. Below spring retention block 124, connecting rod 120 threadedly receives a shock absorber piston 136 thereon. Shock absorber piston 136 has a pair of seals 138 and 140 annularly disposed therearound for sealing engagement to the interior wall of valve control cylinder 96. Shock absorber piston 136 also has a port 150 which extends substantially longitudinally through piston 136 and communicates between the chamber above the piston and below the piston. As can be seen in FIG. 2, fluid, such as oil, is loaded within shock absorber cylinder region 152 defined between the lower end 154 of valve control cylinder 96 and the bottom surface of spring retention block 124. A compression spring 160 encircles connecting rod 120 and is positioned between spring retention block 124 and primary piston 122. As can be appreciated, as connecting rod 120 and primary piston 122 move downwardly, compression spring 160 will be compressed. Spring 160 normally biases primary piston 122 upwardly in valve control cylinder 96.

Where there is sufficient pressure in valve body 24 below flapper valve 50, that is downhole pressure, such pressure in conjunction with the upward bias provided by compression spring 160 on primary piston 122 forces the valve to the closed position as shown in solid lines in FIG. 2 with the valve seated against primary seal 62.

The valve is selectively opened using hydraulic control pressure which is applied to control body 80 by way of control line 82. Referring specifically to FIG. 2, fluid is selectively supplied through port 94 into a chamber 200 defined within valve control cylinder 96 and between primary piston 122 and a stationary plug 202 thereabove. Stationary plug 202 includes an annular seal structure 204 having an aperture 206 therethrough for receiving connecting rod 120 therethrough. Annular seals 208 are provided around 202 to form a fluid tight seal between the plug and control cylinder 96.

By loading fluid into chamber 200, primary piston 122 is forced downwardly in valve control cylinder 96, compressing spring 160. As primary piston 122 moves downwardly, control piston 100 likewise is moved downwardly in cylinder 96 by virtue of its connection to primary piston 122 by way of connecting rod 120. As control piston 100 moves downwardly in cylinder 96, control link 104 likewise translates downwardly to pivot flapper valve 50 about pin 54 to an open position. FIG. 2 shows, in phantom, valve 50 in an intermediate position between fully open and fully closed. Slot 98 in cylinder 96 permits control link 104 to move downwardly relative to cylinder 96.

Shock absorber piston 136 likewise moves downwardly in chamber 152. Fluid below piston 136 flows through port 150 above the piston to permit the movement of the piston in the fluid filled chamber.

The present invention provides controlled closing of flapper valve 50 which is unlike that provided in any prior art structure. Specifically, where an emergency occurs, such as in the malfunction or damage of the wellhead, production facilities, pipeline or otherwise, such that flow through valve 50 must be shut off immediately, the venting of hydraulic fluid out of chamber 200 by way of control line 82 permits primary piston 122 to rise in valve control cylinder 96. As primary piston 122 rises, control piston 100 moves to a raised position and flapper valve 50 is pivoted closed. As can be appreciated in view of the present structure and disclosure, infinite control of the movement of valve 50 is provided by the present system. By controlling the flow of fluid through control line 82, and in conjunction with controlling the fluid passing from the top and bottom of piston 136 in chamber 152 by way of passage 150, flapper valve 50 may be closed in a controlled manner even though extremely large pressures may be acting from below, on the valve, particularly as the valve moves into the stream of flow of fluid through the assembly. Further, the control system is displaced to one side of the valve body, and thereby does not interfer with the movement of tools into and out of the well. Further, the control connection between control piston 100 and flapper valve 50 is at pin 108, which is remote from the hinge pin 54. Thus, substantial mechanical advantage is provided by the present design in control of the flapper design.

To further control the closure of valve 50, and specifically to prevent the high stresses which are encountered in present safety valves where slamming closure is permitted, shock absorber piston 136 acts to resist rapid upward movement of connecting rod 120 and thereby controls the closure of valve 50. Port 150 may be sized according to the particular application of the present valve, to control the resistance provided by shock absorber piston 136. By incorporating a smaller port in piston 136, more resistance is provided, and by increasing the size and flow capacity of port 150, such as the usage of a variable orifice, less resistance is provided.

As can also be seen in FIG. 2, a stop 220 is provided on the back side of valve 50 and prevents overtravel of the valve as it is moved to the open position. Stop 220 engages the side wall of valve body 24 to prevent the valve from moving to an overtraveled position which would preclude closure of the valve by the upward movement of control piston 100 and associated link 104. Further, hinge pin 54 of valve 50 is substantially in line with the longitudinal axis of valve control cylinder 96.

Figure 3:
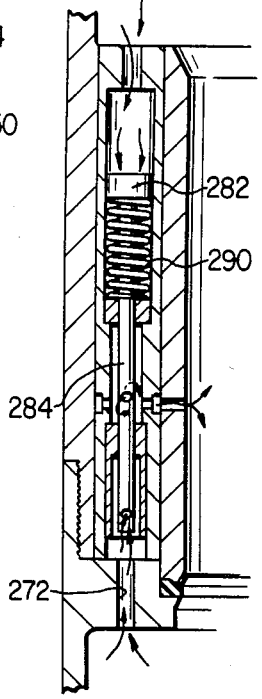
FIG. 3 is an enlarged section view of the equalizer valve, showing the valve in its open position.

The present system also provides an equalizing valve assembly 260 which permits equalizing the pressure in the valve body above and below valve 50 to facilitate opening of the valve. Referring to FIGS. 1 and 3, equalizing valve assembly includes a central bore 262 which receives a sleeve 264 therein. Sleeve 264 includes a lower equalizing piston bore 266 with a reduced diameter bore 268 thereabove. A larger bore 270 is formed in sleeve 264 and communicates to the area above valve 50. Internally formed ring 52 has a bore 272 formed therethrough which communicates between the area below valve 50 and bore 266 of sleeve 264. Sleeve 264 is sealingly engaged within the valve assembly cylinder 266 using appropriate seals such as seals 285.

A stationary equalizing sleeve 283 is positioned within bore 266. A hollow shaft 284 has one end slidably engaged through equalizing piston 282. Hollow shaft 284 has its upper end extending through a lower packing piston 286, which is seated within bore 270, and attached for movement with an upper packing piston 282. Piston 282 has appropriate seals 289 for sealing against the side wall of bore 270. A spring 290 is positioned around shaft 284 and is entrapped between pistons 282 and 280. Shaft 284 has an upper port 292 and a lower port 294 formed there the sidewall thereof to provide for fluid communication between the two ports. A venting port 296 is formed laterally from bore 268 of sleeve 264 and communicates by way of an annular groove 298 to ports 300 extending through the side wall of valve assembly 260 communicating into the area above valve 50.

As can be seen in FIG. 3, spring 290 biases upper packing piston 282 upwardly raising equalizing piston 283 to its uppermost limit of travel. In this position, sleeve 264 and particularly ports 292 and 294 are not in registration with either ports 296 through sleeve 264 or into the central cavity defined by sleeve 282. Appropriate seals 310 and 312 form a seal between lower packing piston 280 and equalizing sleeve 283 and shaft 284, respectively.

Figure 4:
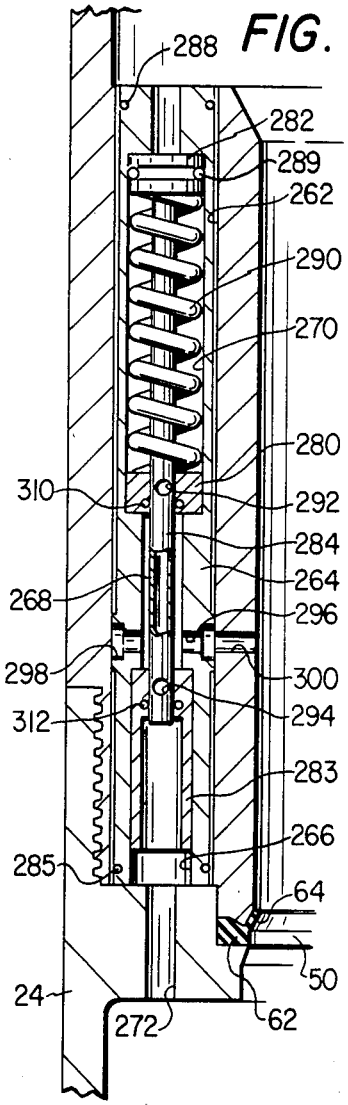
FIG. 4 is a slightly reduced enlarged section view of the equalizer valve, showing the valve in the closed position.

As can be seen in FIG. 4, by applying pressure into the valve body above valve 50, piston 282 moves downwardly to compress spring 290 moving hollow shaft 284 to the position shown in FIG. 4. Because piston 282 has a larger area than the flow provided by shaft 284, the surface pressure on piston 282 required to move the piston downwardly is less than the well hydrostatic pressure acting on shaft 284.

In the down position (FIG. 4), port 292 registers with port 296 of sleeve 264. Port 294 of shaft 284 moves within the central cavity of equalizing sleeve 282. Fluid pressure may then be communicated from below valve 50 to above the valve through bore 272, the central cavity of equalizing sleeve 282, through shaft 284 and port 296 and port 300 through sleeve 264 in the equalizing valve assembly body, respectively. Upon equalization of the pressure above and below valve 50, a lesser force is then required to open valve 50, this being accomplished as described above with respect to the injection of fluid pressure into the valve control cylinder through control line 82 (FIG. 1).

Thus, the present invention provides a safety valve which may be surface controlled. The valve is an equalizing, flapper-type, tubing retrievable assembly. Its primary design is for shutting in an oil or gas well at a point below the earth's surface in the event of damage to the wellhead, flowline or malfunction of other surface equipment.

Although the embodiment discussed above refers to use of the valve in a subsurface position, it will be clear to those skilled in the art that the valve may be used at or near the surface of the well bore. Further, the valve may be used in other than oil field applications, and may be used in any environment where a safety valve is needed to control the flow of fluid through a pipe system. Thus, the present system is ideally suited for safety control of fluid in power plants, including nuclear power plants.

The valve is normally closed, and is held open by hydraulic control pressure from the surface. The hydraulic control pressure is transmitted from the surface source by way of an external control line to the valve. The valve is designed with a resilient seal, backed by a metal to metal seat, on the primary sealing surface. The valve includes a control piston opposed by a compression spring which operates a flapper valve. The valve, opened by hydraulic control pressure, remains open while the pressure is applied, and closes when the pressure is released.

Upon loss of hydraulic pressure in the control line to the valve, the compression spring moves a primary piston, and a control piston attached thereto by a connecting rod, upwardly. The control piston is connected by way of a control link to the hinged flapper valve which is pivoted to the closed position. The valve is also designed to allow the well flow to create a differential pressure and assist in closing the valve. However, slamming closure is prevented even where hydraulic control pressure is shut off completely by incorporation of a shock absorber piston, attached to the primary and control pistons by the connecting rod. The shock absorber piston moves in a chamber of fluid, loaded below and above the piston. A port through the shock absorber piston, communicating between the area above and below the piston, permits control movement of the piston thereby providing a resistance to such movement and preventing slamming closure of the valve.

During opening and closing of the valve, the control to the valve, provided by a control link, applies load to the valve at a point removed from the hinge point. Thus, loading is distributed over the entire valve area rather than being concentrated at the hinge point. This loading is substantially different from that experienced by sleeve actuated valve designs which generally have only a single point of pivoting connection to the valve body.

An equalizing valve is disclosed in the present invention which permits, upon pressurizing within the tubing string above the flapper valve, the movement of equalizing valve components to permit the communication of pressure from below the valve to the area above the valve. After equalizing pressure above and below the valve, reopening can be achieved.

Figure 5:
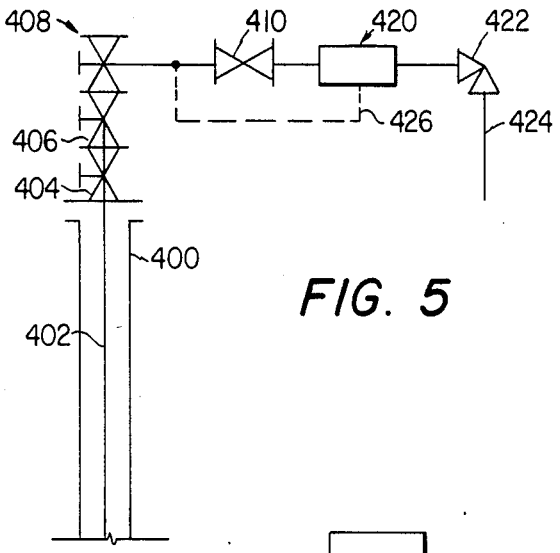
FIG. 5 is a schematic showing an alternative positioning of the safety valve of the present invention at the well surface.

Although the safety valve design described above has been discussed as used at a subsurface location in the tubing string, it will be understood by those skilled in the art that the present invention may also be used at a surface location to provide a flow control pressure release mechanism at the well surface. FIG. 5 depicts in a schematic representation of one of several locations in which the safety valve structure, illustrated in detail in FIGS. 1 through 4, may be located. Specifically, FIG. 5 shows production casing 400 with production tubing 402 therein. Appropriate valving is illustrated at the wellhead, including a lower master valve 404, a master valve 406, and a swab valve 408. A wing valve 410, with a manual operator is positioned in communcation with swab valve 408. The safety valve of the present invention, referred to by numeral 420 is positioned intermediate of a choke mechanism 422 and wing valve 410. Sales line 424 is connected to choke 422. A sensor line 426 is provided between safety valve 420 and production tubing connecting wing valve 410 to swab valve 408. This sensor line communicates flow line pressure to control body 80 (FIG. 1) by way of port 94 (FIG. 2) above primary piston 122. The communication of pressure within valve control cylinder 96 (FIG. 2) above primary piston 122 (FIG. 2) acts to maintain the piston in a retracted position thereby maintaining flapper valve 50 in an open position. Thus, flow from wing valve 410 to choke 422 is by way of a fully open, unrestricted in line safety valve. This arrangement reduces the likelihood of erosion and reduces turbulence during production. Further, less turbulence is produced during closure of the valve. The safety valve may be manually controlled or may be controlled by sensing particular parameters with respect to the production of the well. By using such sensors, the pressure applied by sensor line 426 may be interrupted to automatically close safety valve 420 in response to the any parameter being monitored by the sensor.

Figure 6:
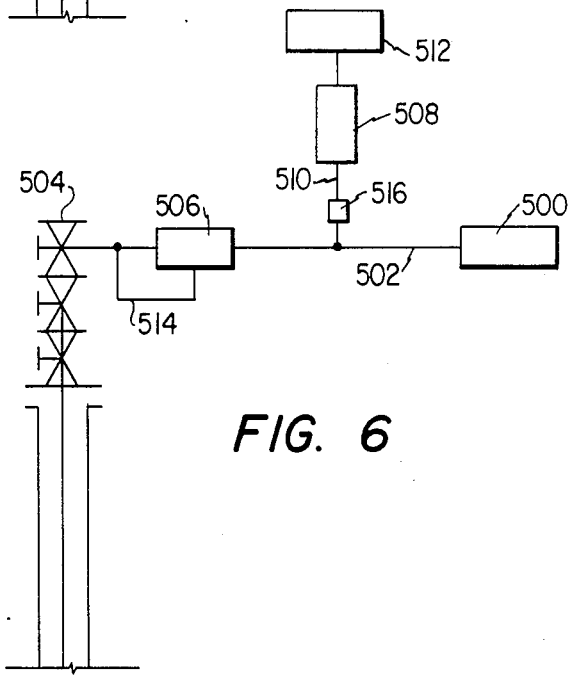
FIG. 6 is a schematic showing a further alternative position of the safety valve of the present invention at the well surface.

FIG. 6 shows a further schematic depicting use of the present safety valve for purposes of diverting flow from a treatment source normally used to inject fluids into the well. Use of the safety valve in the treating line from a pump source for injecting fracturing fluids into the well can prevent pressure overload in the treating line where, for example, a screenout occurs.

In the schematic of FIG. 6, a pump source 500, such as a pump truck, is connected by way of a treating line 502 to the wellhead 504. Safety valve 506 is positioned within treatment line 502 and is connected to a deenergizing structure 508, such as a baffle arrangement, by an appropriate line 510. A fluid receiving pit is generally depicted at 512. A sensor line 514 is connected between the safety valve 506 and the wellhead side of the treatment line 502. Sensor line 514 is connected in the same way as sensor line 426 referred to in the embodiment described and shown in FIG. 5. One way release valve 516 is positioned in line 510 between treating line 502 and deenergizer 508.

In this arrangement, when excessive pressures are generated in treatment line 502 on the wellhead side of safety valve 506, this pressure is communicated to the safety valve, as hereinabove described, to cause the valve to close and divert flow through release valve 516 and deenergizer 508 to pit 512. In this way, the stresses which would normally be applied to the downhole tubulars is released through a deenergizer system into pit 512.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

We claim:

1. An oil or gas well safety valve comprising:

a valve body having a valve seat therein, a flapper valve, hinge means for supporting said valve from said valve body, said hinge means being adjacent the valve seat and adjacent the wall of the valve body for movement from a closed position wherein said valve is seated against said seat and an open position wherein said valve is pivoted from said seat, control means, positioned within said valve body and to side of said valve to which said valve opens, for engaging said valve at a point removed from said hinge means from selectively applying a force to said valve to pivot said valve between its closed and opened position, said control means comprising a cylinder having upper, intermediate and lower chambers, a control piston moveable in said upper chamber, a control link attached between said control piston and said valve for transmitting the movement of said control piston to said valve, a primary piston moveable in said intermediate chamber, said control and primary pistons connected by a rod therebetween, a compression spring positioned in the intermediate chamber below said primary piston for biasing said primary piston toward said valve, port means in said intermediate chamber above said primary piston whereby the introduction of fluid into said intermediate chamber causes said primary piston to move away from said valve, a shock absorber piston for movement in said lower chamber and connected for movement with said primary piston, said lower chamber being filled with a fluid and said shock absorber piston having an aperture therethrough communicating to either side thereof whereby the fluid in the lower chamber may move from one side of said piston to the other during movement thereof, said aperture being sized to control the movement of said shock absorber piston therein.

2. The safety valve according to claim 1 wherein the hinge means is substantially aligned with the extension of the longitudinal axis of said control piston cylinder.

* * * * *